US009630051B2

(12) United States Patent
Lin

(10) Patent No.: US 9,630,051 B2
(45) Date of Patent: Apr. 25, 2017

(54) ADJUSTABLE AND SWINGABLE EXERCISE BIKE

(71) Applicant: BH Asia Ltd., Taichung (TW)

(72) Inventor: Fu-Hai Lin, Taichung (TW)

(73) Assignee: BH ASIA LTD., Taichung (TW)

( * ) Notice: Subject to any disclaimer, the term of this patent is extended or adjusted under 35 U.S.C. 154(b) by 252 days.

(21) Appl. No.: 14/288,059

(22) Filed: May 27, 2014

(65) Prior Publication Data

US 2015/0238808 A1 Aug. 27, 2015

(30) Foreign Application Priority Data

Feb. 27, 2014 (TW) ..... 103203416 U

(51) Int. Cl.

| | |
|---|---|
| ***A63B 21/00*** | (2006.01) |
| ***A63B 22/06*** | (2006.01) |
| ***A63B 21/008*** | (2006.01) |
| ***A63B 21/02*** | (2006.01) |
| ***A63B 21/22*** | (2006.01) |
| ***A63B 22/00*** | (2006.01) |
| *A63B 71/00* | (2006.01) |

(52) U.S. Cl.

CPC ..... *A63B 22/0605* (2013.01); *A63B 21/0083* (2013.01); *A63B 21/0087* (2013.01); *A63B 21/028* (2013.01); *A63B 21/225* (2013.01); *A63B 22/0023* (2013.01); *A63B 21/00181* (2013.01); *A63B 2022/0641* (2013.01); *A63B 2071/009* (2013.01); *A63B 2225/09* (2013.01)

(58) Field of Classification Search

CPC ..... A63B 21/00
USPC ..... 482/57, 61
See application file for complete search history.

(56) References Cited

FOREIGN PATENT DOCUMENTS

| | | |
|---|---|---|
| TW | M314622 | 2/2014 |
| TW | M471910 | 2/2014 |

*Primary Examiner* — Jerome W Donnelly
(74) *Attorney, Agent, or Firm* — Ming Chow; Sinorica, LLC

(57) ABSTRACT

An adjustable and swingable exercise bike includes a base, a bike body and multiple cushion units. The base has two connecting portions, and each connecting portion has a supporting rod protruding upward and a shaft seat mounted on a top of the supporting rod. The bike body is mounted on the base and has a bike frame and two swinging seats. The bike frame has a front end and a rear end. The swinging seats are respectively and securely mounted on the front end and the rear end of the bike frame, and each swinging seat is pivotally connected with the corresponding supporting rod. The cushion units are elastic, elongated and respectively mounted between the connecting portions and the swinging seats. The cushion units can help the bike body of the exercise bike simulate a situation of riding a real bike.

18 Claims, 7 Drawing Sheets

ADJUSTABLE AND SWINGABLE EXERCISE BIKE

The current application claims a foreign priority to the patent application of Taiwan No. 103203416 filed on Feb. 27, 2014.

BACKGROUND OF THE INVENTION

1. Field of the Invention

The present invention relates to an indoor exercise equipment and more particularly to an adjustable and swingable exercise bike.

2. Description of Related Art

A conventional exercise bike is used in exercise that simulates riding a real bike to train the muscle of the legs, to strengthen functions of the heart and the lung, and to improve the blood circulation.

The conventional exercise bike has shortcomings such as being monotonous and lack of entertaining effects, all of which cause people to give up exercising easily. A TW patent No. M314622 discloses a swingable exercise bike to overcome the shortcomings of the conventional exercise bike, but the swingable exercise bike also has some problems such as complicated structure, difficulty in assembly, and being unable to swinging in a wide range.

To solve the shortcomings of the patent M314622, the applicant disclosed in TW patent No. M471910 a swingable apparatus for an exercise bike, which has a swinging seat held by multiple cushions that are made of cylindrical rubber or are coil springs to sustain a preferred inclination of the swinging seat.

However, the patent M471910 also has some shortcomings, including that the swinging seat is unable to be adjusted by a user, or the cushions no longer sustain the preferred inclination of the swinging seat when elasticity fatigue of the cushions occurs.

To overcome the shortcomings of the conventional exercise bike, the present invention provides an adjustable and swingable exercise bike to mitigate or obviate the aforementioned problems.

SUMMARY OF THE INVENTION

The main objective of the invention is to provide an adjustable and swingable exercise bike. The adjustable and swingable exercise bike includes a base, a bike body and multiple cushion units.

The base has two connecting portions, and each connecting portion has a supporting rod protruding upward and a shaft seat mounted on a top of the supporting rod. The bike body is mounted on the base and has a bike frame and two swinging seats. The bike frame has a front end and a rear end. The swinging seats are respectively and securely mounted on the front end and the rear end of the bike frame, and each swinging seat is pivotally connected with the corresponding supporting rod. The cushion units are elastic, elongated and respectively mounted between the connecting portions and the swinging seats.

Other objects, advantages, and novel features of the invention will become more apparent from the following detailed description when taken in conjunction with the accompanying drawing.

DETAILED DESCRIPTION OF PREFERRED EMBODIMENT

Figure 1:
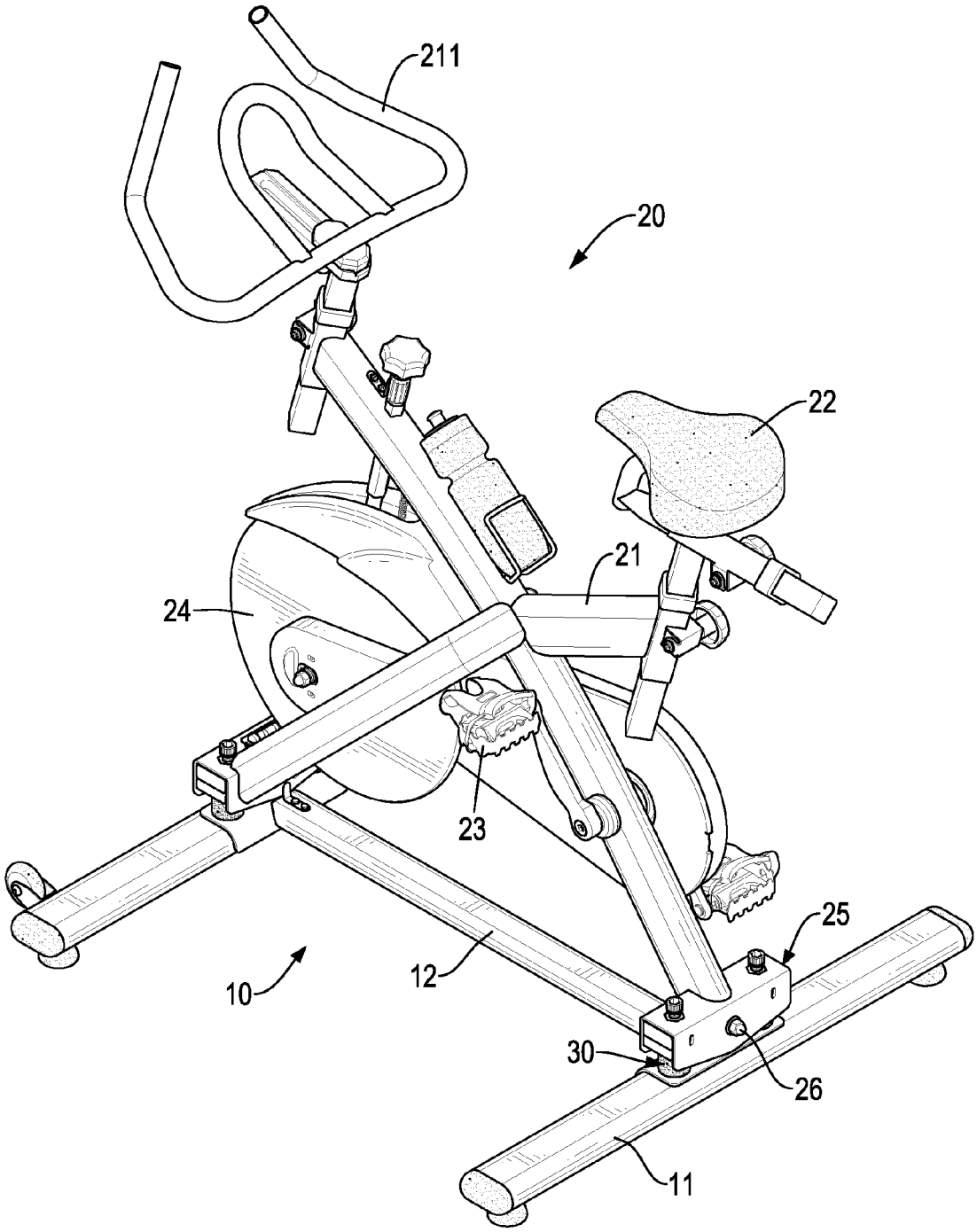
FIG. 1 is a perspective view of an adjustable and swingable exercise bike in accordance with the present invention.
Figure 2:
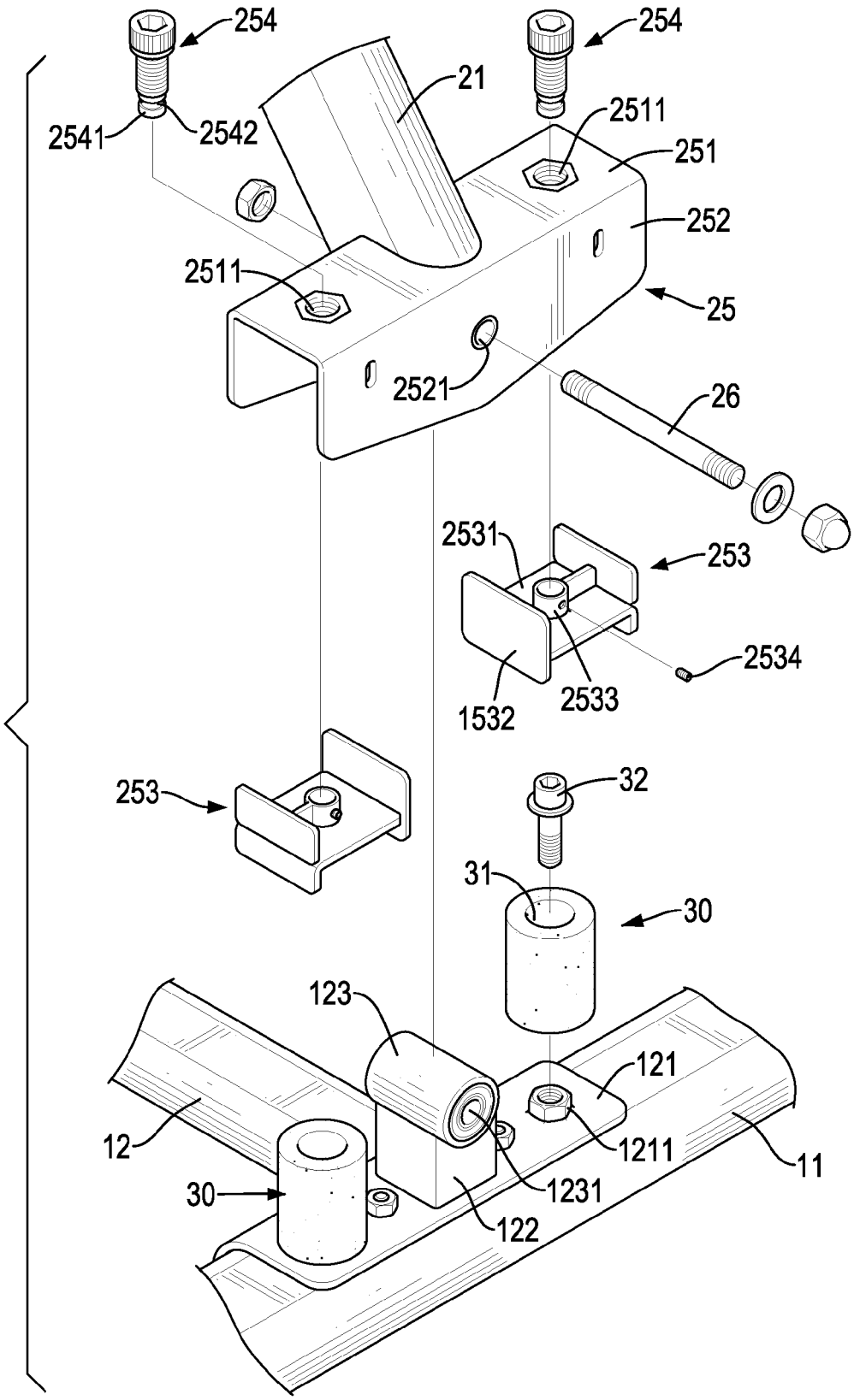
FIG. 2 is an enlarged exploded perspective view of the adjustable and swingable exercise bike in FIG. 1.

With reference to FIGS. 1 and 2, a preferred first embodiment of an adjustable and swingable exercise bike includes a base 10, a bike body 20 and multiple cushion units 30.

The base 10 is H-shaped, is horizontally placed on floor as a firm and stable support of the exercise bike, and has two horizontal tubes 11 parallel with each other and a connecting tube 12 connected with the horizontal tubes 11. The connecting tube 12 has two connecting portions located at two ends of the connecting tube 12. Each connecting portion includes a connecting plate 121, a supporting rod 122 and a shaft seat 123. The connecting plate 121 is L-shaped in cross-section and has two cushion holes 1211 formed in a top of the connecting plate 121. The supporting rod 122 protrudes upward from a central section of the connecting plate 121 and is located between the cushion holes 1211. The shaft seat 123 is mounted on a top of the supporting rod 122 and has a shaft hole 1231 traversely formed through the shaft seat 123.

With reference to FIGS. 1 and 2, the bike body 20 is mounted on the base 10 and has a bike frame 21, a seat 22, two pedals 23, a flywheel 24, two swinging seats 25 and two pivot shafts 26. The type and design of the base 10 and the bike body 20 may be conventional. The bike frame 21 is assembled by metal tubes and has a front end, a rear end, and a handlebar 211. The handlebar 211 is mounted on a top of the front end of the bike frame 21 for a user to grip the handlebar 211. The seat 22 is mounted on a middle section of the bike frame 21. The pedals 23 are respectively mounted on two sides of the bike frame 21 and are located adjacent to a bottom section of the bike frame 21. The flywheel 24 is mounted on the bottom section of the bike frame 21, is connected with the pedals 23 and is driven by the pedals 23. When a user treads on the pedals 23, the flywheel 24 provides damping or inertia for assist in the riding exercise.

Figure 3:
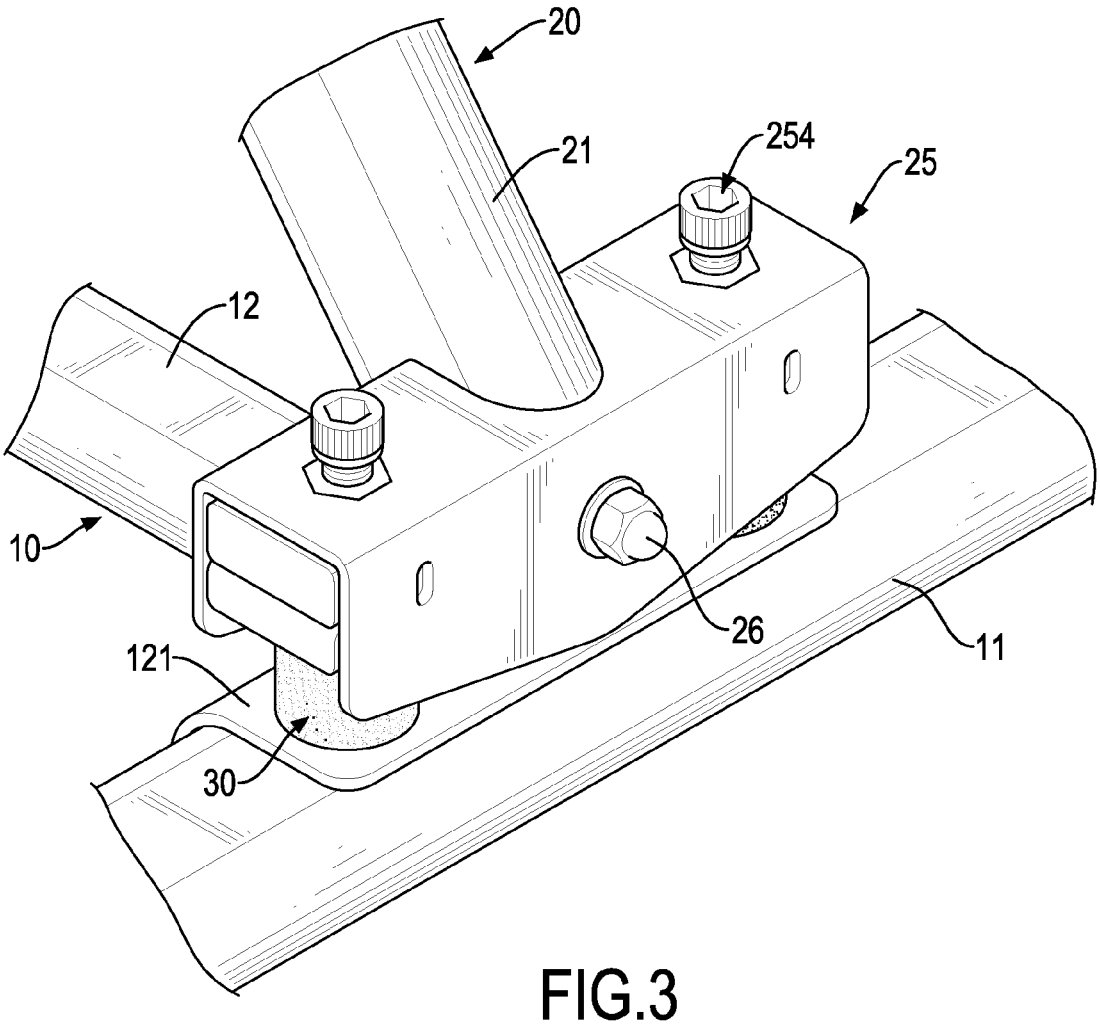
FIG. 3 is an enlarged perspective view in partial section of the adjustable and swingable exercise bike in FIG. 1.
Figure 4:
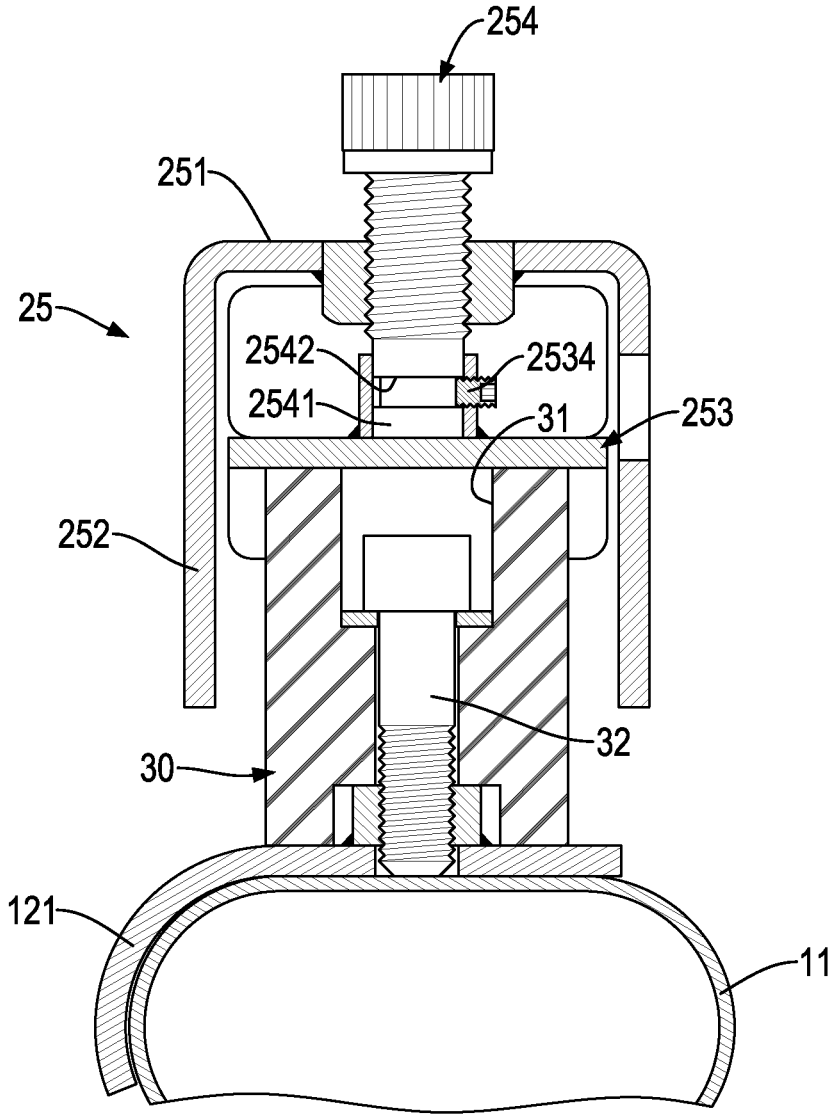
FIG. 4 is an enlarged side view in partial section of the adjustable and swingable exercise bike in FIG. 1.

With reference to FIGS. 2 to 4, the swinging seats 25 are U-shaped in cross-section and are respectively securely mounted on the front end and the rear end of the bike frame 21. Each swinging seat 25 has a seat board 251, two supporting plates 252, two moveable seats 253 and two adjusting bolts 254.

The seat board 251 is rectangular and is horizontally mounted on the bike body 20 and has two horizontal edges and two adjusting holes 2511 formed through the seat board 251. The adjusting holes 2511 are threaded holes.

The supporting plates 252 parallelly and respectively protrude downward from the horizontal edges of the seat board 251. Each supporting plate 252 has a pivot hole 2521 formed through the supporting plate 252 and aligned with the shaft hole 1231.

A moveable space of the swinging seat 25 is formed in a bottom of the swinging seat 25 and located between the seat board 251 and the supporting plates 252.

The moveable seats 253 are H-shaped in longitudinal cross-section, are mounted in the moveable space of the swinging seat 25, and are located at two sides of the moveable space. Each moveable seat 253 has a pressing board 2531, two side boards 2532, a socket 2533 and a screw 2534. The pressing board 2531 is horizontally disposed and has two side edges. The side boards 2532 are respectively and longitudinally mounted at the side edges of the pressing board 2531 and provide protection and reinforcement effect. The socket 2533 is mounted on a center of the pressing board 2531, and has a mounting recess and a screw hole formed through the periphery of the socket 2533 and communicating with the mounting recess. The screw 2534 is mounted in the screw hole and can protrude into the mounting recess.

The adjusting bolts 254 are respectively mounted through the adjusting holes 2511, and each adjusting bolt 254 is inserted in the socket 2533 and has a joint 2541 formed on a bottom of the adjusting bolt 254 and a groove 2542 formed around a periphery of the joint 2541. The joint 2541 is rotatably mounted in the socket 2533. The screw 2534 can be inserted in the groove 2542 to fix the adjusting bolt 254 in the socket 2533. The adjusting bolts 254 are adjustable along the adjusting holes 2511 and move the corresponding moveable seats 253 up and down.

The pivot shaft 26 is mounted through the pivot hole 2521 and the shaft hole 1231 to pivotally connect the swinging seat 25 with the supporting rod 122.

With reference to FIGS. 2 and 4, the cushion units 30 may be elastic cylindrical rubbers, coil springs, damper cylinders or elastic steel boards, etc. In the first embodiment of the present invention, the cushion units 30 are respectively mounted on the connecting plates 121. Each cushion unit 30 is an elastic, elongated cylindrical rubber and has a bolt hole 31 formed through the cushion unit 30 and a bolt 32 mounted in the bolt hole 31 and screwed in the corresponding cushion hole 1211 to connect the cushion unit 30 with the connecting plate 121.

Figure 5:
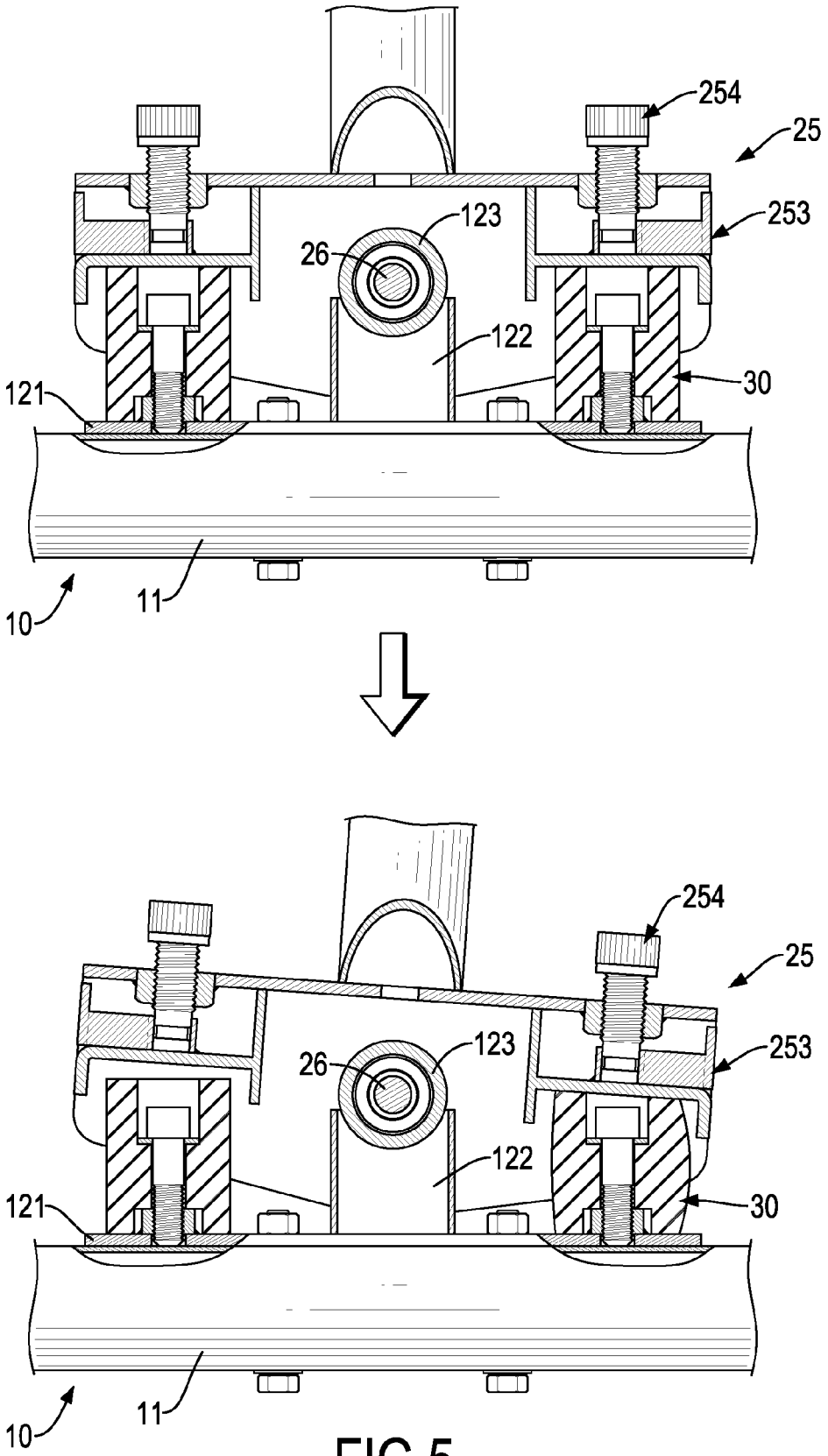
FIG. 5 shows enlarged operational front views in partial section of the adjustable and swingable exercise bike in FIG. 1.

With reference to FIGS. 1 and 5, the bike body 20 is held by the cushion units 30, and the swinging seat 25 can be swung by elasticity of the cushion units 30. When the user rides on the bike body 20 and treads on the pedals 23, the body of the user swings back and forth horizontally, so the swinging seat 25 is swung horizontally and the corresponding side of the cushion unit 30 is compressed by the movement of the user. Therefore, the cushion units 30 help the bike body 20 simulating a situation of riding a real bike, and provides fun and variations during exercising. The structure of the cushion units 30 is simple, easy to install, and flexible in use.

Figure 6:
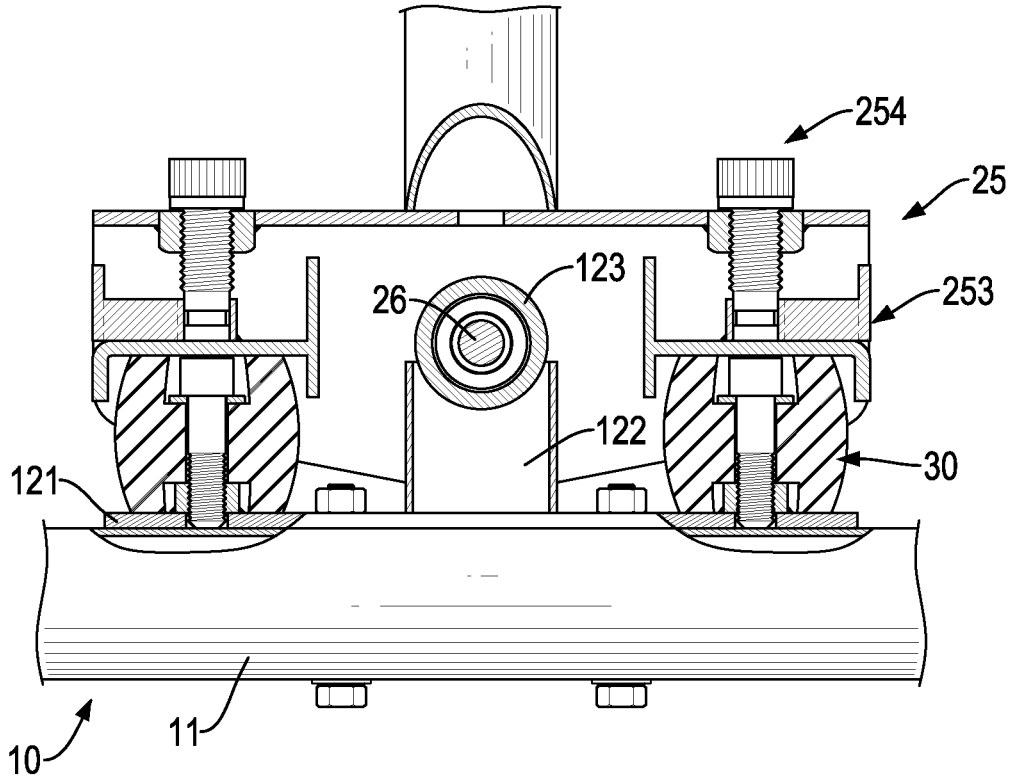
FIG. 6 is an enlarged front view in partial section of the adjustable and swingable exercise bike in FIG. 5, showing the adjustable and swingable exercise bike after adjustment.

With reference to FIGS. 5 and 6, the moveable seats 253 can be moved up or down by rotating the adjusting bolts 254 to compress or release the cushion units 30, so the movement of the swinging seat 25 can be controlled by the moveable seats 253. Therefore, the bike body 20 can set different swinging movements according to the user demands and habits. Furthermore, if the cushion units 30 have elasticity fatigue after a long term use, the adjusting bolts 254 can adjust the moveable seats 253 to a suitable and correct inclination position.

Figure 7:
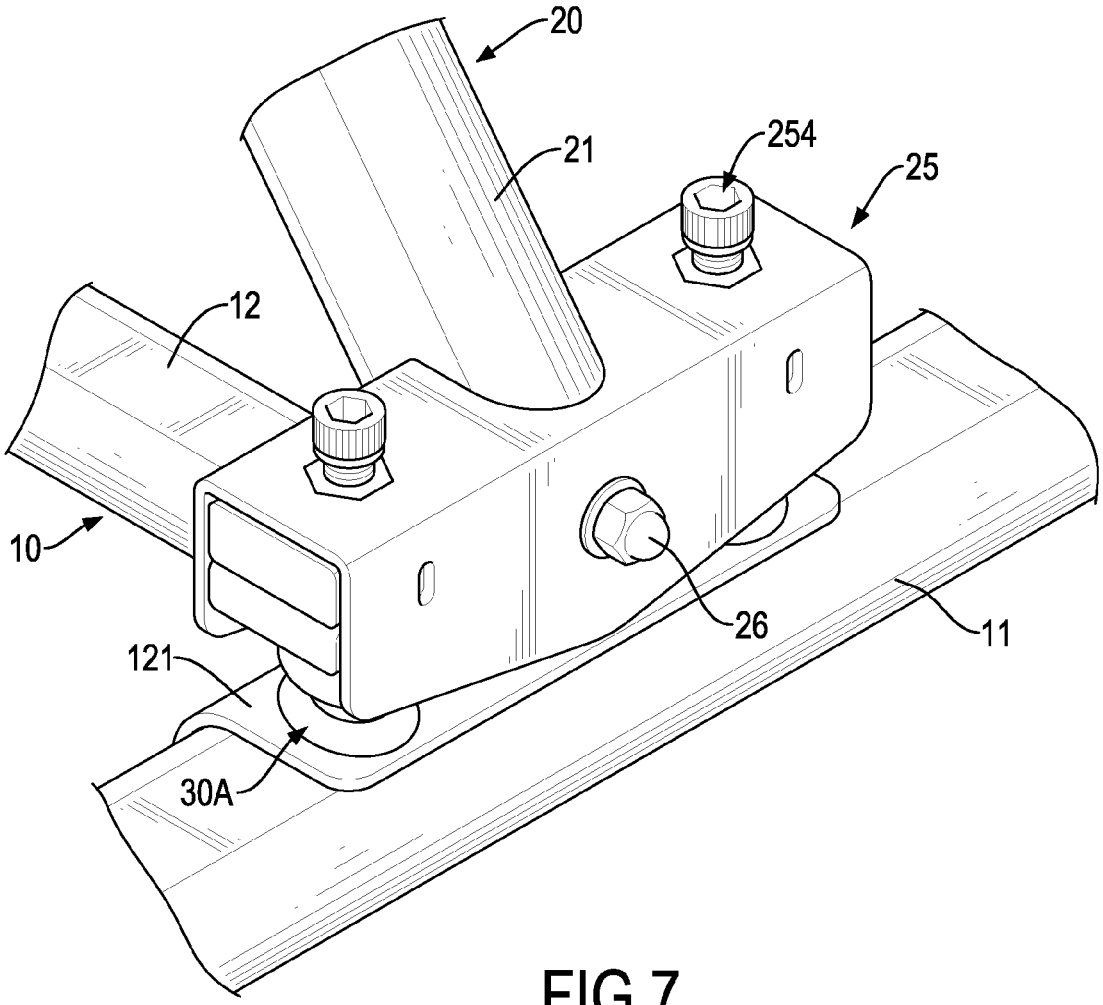
FIG. 7 is an enlarged perspective view in partial section of a second embodiment of the adjustable and swingable exercise bike in accordance with the present invention.

With reference to FIG. 7, in a second embodiment of an adjustable and swingable exercise bike in accordance with the present invention, the elements and effects of the second embodiment are same as those of the first embodiment except the cushion units 30A are coil springs.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An adjustable and swingable exercise bike comprising:
- a base having
  - two connecting portions, each connecting portion having
    - a supporting rod protruding upward; and
    - a shaft seat mounted on a top of the supporting rod and having
- a shaft hole traversely formed through the shaft seat;
  - a bike body mounted on the base and having
    - a bike frame having a front end and a rear end; and
    - two swinging seats respectively and securely mounted on the front end and the rear end of the bike frame, each swinging seat pivotally connected with the supporting rod by a pivot shaft and having
      - a moveable space formed in a bottom of the swinging seat;
      - two moveable seats moveably mounted in the moveable space and located at two sides of the moveable space, and each moveable seat having a pressing board; and
      - two adjusting bolts respectively and adjustably mounted through the swinging seat and connected with the pressing boards of the moveable seats; and
- multiple cushion units being elastic, elongated, and respectively mounted between the connecting portions and the swinging seats.

2. The adjustable and swingable exercise bike as claimed in claim 1, wherein each
- swinging seat has
- a seat board having two horizontal edges; and
- two supporting plates parallelly and respectively protruding downward from the horizontal edges of the seat board; and
- the moveable space is located between the seat board and the supporting plates.

3. The adjustable and swingable exercise bike as claimed in claim 2, wherein
- each connecting portion includes a connecting plate, the connecting plate is L-shaped in cross-section and has two cushion holes formed in the connecting plate and located at two sides of the supporting rod; and
- each cushion unit has a bolt mounted in one of the cushion holes of the connecting plate to fix the cushion unit on the connecting plate.

4. The adjustable and swingable exercise bike as claimed in claim 3, wherein
- each pressing board has a socket; and
- each adjusting bolt has a joint formed on a bottom of the adjusting bolt and connected with the socket of the pressing board.

5. The adjustable and swingable exercise bike as claimed in claim 4, wherein each joint of the adjusting bolt has a groove formed around a periphery of the joint; and each moveable seat has a screw mounted through the socket and protruding in the groove of the joint.

6. The adjustable and swingable exercise bike as claimed in claim 5, wherein each moveable seat is H-shaped in longitudinal cross-section and has two side boards respectively and longitudinally mounted at two side edges of the pressing board.

7. The adjustable and swingable exercise bike as claimed in claim 1, wherein the cushion units are elastic cylindrical rubbers.

8. The adjustable and swingable exercise bike as claimed in claim 2, wherein the cushion units are elastic cylindrical rubbers.

9. The adjustable and swingable exercise bike as claimed in claim 3, wherein the cushion units are elastic cylindrical rubbers.

10. The adjustable and swingable exercise bike as claimed in claim 4, wherein the cushion units are elastic cylindrical rubbers.

11. The adjustable and swingable exercise bike as claimed in claim 5, wherein the cushion units are elastic cylindrical rubbers.

12. The adjustable and swingable exercise bike as claimed in claim 6, wherein the cushion units are elastic cylindrical rubbers.

13. The adjustable and swingable exercise bike as claimed in claim 1, wherein the cushion units are coil springs.

14. The adjustable and swingable exercise bike as claimed in claim 2, wherein the cushion units are coil springs.

15. The adjustable and swingable exercise bike as claimed in claim 3, wherein the cushion units are coil springs.

16. The adjustable and swingable exercise bike as claimed in claim 4, wherein the cushion units are coil springs.

17. The adjustable and swingable exercise bike as claimed in claim 5, wherein the cushion units are coil springs.

18. The adjustable and swingable exercise bike as claimed in claim 6, wherein the cushion units are coil springs.

* * * * *